US005499428A

United States Patent [19]

Okada

[11] Patent Number: 5,499,428

[45] Date of Patent: Mar. 19, 1996

[54] FLUSH HINGE FOR ATHLETIC COURT DOORS

[76] Inventor: Paul M. Okada, 12670 E. 132nd Ave., Brighton, Colo. 80601

[21] Appl. No.: 188,938

[22] Filed: Jan. 31, 1994

[51] Int. Cl.[6] ..... E05D 11/06

[52] U.S. Cl. ..... 16/387; 16/221; 16/374; 16/388

[58] Field of Search ..... 16/374, 377, 382, 16/387, 388, 221; 49/398

[56] References Cited

U.S. PATENT DOCUMENTS

| | | | |
|---|---|---|---|
| 316,705 | 4/1885 | Weller | 49/398 |
| 2,288,013 | 6/1942 | Moynahan et al. | 16/388 |
| 4,574,426 | 3/1986 | Pearson | 16/389 |
| 5,079,798 | 1/1992 | Burke et al. | 16/252 |

FOREIGN PATENT DOCUMENTS

| | | | |
|---|---|---|---|
| 1374930 | 8/1964 | France | 16/389 |
| 14751 | 7/1892 | United Kingdom | 16/377 |

*Primary Examiner*—Daniel W. Howell

*Assistant Examiner*—Donald M. Gurley

*Attorney, Agent, or Firm*—Ancel W. Lewis, Jr.

[57] ABSTRACT

A flush hinge for pivotally connecting a door to an adjacent wall wherein first and second hinge members are connected by a pintle to move about a pivot axis. The pivot axis is substantially centered in the width dimension of each of the first and second knuckle portions and an inside face of each knuckle portions forms a stop face for the door or wall to position them inside the pivot axis so the ends of the hinge members remain in close proximity as the first hinge member moves. The first and second hinge members have a tongue and groove fitting and stop faces that abut to hold the hinge member in both open and closed positions. In a first embodiment the pivot axis is substantially centered between adjacent edges of the door and walls with an inner face of the hinge being in the same plane as the door and wall to fill a gap therebetween. The first embodiment has a base portion that extends into a hollow wall support and fastens to the inside thereof. A second embodiment has a base portion that fastens to a wall fin substantially centered in the gap and forms a part of the playing surface. A third embodiment has a base portion projecting rearwardly of the stationary second leaf portion, attaches to the back side of a support fin and utilizes a notch in the wall.

22 Claims, 4 Drawing Sheets

FLUSH HINGE FOR ATHLETIC COURT DOORS

TECHNICAL FIELD

This invention relates to hinges and more particularly to a novel flush hinge particularly suitable for use with the doors in athletic or game courts such as squash or racquetball/handball courts.

BACKGROUND ART

In athletic courts the back wall usually has a door which forms a part of the playing surface. The door and rest of the back wall are usually made of a transparent material such as glass or plastic. The door hinges cannot project beyond the inner surface of the door and back wall as any projections would constitute a hazard to the players and would prevent the ball from rebounding in a predictable manner.

In U.S. Pat. No. 5,297,368 entitled "MOVABLE WALL SYSTEM" there is disclosed a movable wall system that is particularly suitable for using the same back wall for both racquetball/handball courts and squash courts. The movable back wall disclosed has a supporting framework made up of top, bottom, and upright side and intermediate frame members. The hinge disclosed herein is suitable for use in pivotally connecting a door to a wall in the movable wall system disclosed in said copending application.

In U.S. Pat. No. 4,574,426 there is disclosed a flush door hinge that is particularly suitable for athletic or game court doors. This hinge is typically made of a molded plastic and is mounted in a cut-out in the door. The hinge disclosed locates the pivot pin in a substantial distance inwardly from the end edge adjacent the pivot thereby requiring more material for strength and this location of the pintle causes a back swing in the door in the open position and a substantial gap between the end faces of the hinge members as the movable hinge member is moved between open and closed positions. The knuckle portions supporting the pintle are of dissimilar widths. This hinge has an end flange on the end of the stationary hinge member that fastens to a wall-supporting fin. This hinge does not have opposed stop faces on the hinge members that positively stop the door in both the closed position and the open position at an angle of 90 degrees to the closed position.

DISCLOSURE OF THE INVENTION

In accordance with the present invention there is disclosed a hinge having a movable first hinge member and a stationary second hinge member pivotally connected together by a pintle for pivotal movement of the first hinge member about a pivot axis between open and closed positions. The first hinge member has a first knuckle portion and a first leaf portion connected thereto. The second hinge member has a second knuckle portion and a second leaf portion connected thereto. The door is recessed in the first hinge member and the wall is recessed in the second hinge member to provide a substantially planar playing surface along an inner face of each of the door, wall and hinge when the door is in the closed position.

The pivot axis is substantially centered in the width dimension of each of the first and second knuckle portions and the width dimensions of the first and second knuckle portions are substantially the same so the end faces pivoted ends of the hinge members remain in close proximity as the first hinge member is moved between the open and closed positions. An inside face of each knuckle portion forms a stop to dispose the end edge faces of the door and wall inside the pivot axis.

In a first embodiment the pivot axis is substantially centered between a pair of opposed, spaced, edges or faces of the door and wall. The hinge members have knuckle portions with inner faces in a gap between the opposed edge faces of the door and wall that are in substantially the same plane as the inner faces of the door and wall. In the first embodiment the hinge is recessed in a notch in a hollow wall support and fastened inside the wall support. In a second embodiment the hinge has a base portion fastened to a support rib disposed in the gap between the wall and door. In a third embodiment, a narrower base portion extends from the stationary leaf portion and fastens to the back side of a narrower support rib behind the wall.

BRIEF DESCRIPTION OF THE DRAWINGS

Details of this invention are described in connection with the accompanying drawings which like parts bear similar reference numerals in which.

DETAILED DESCRIPTION

Figure 1:
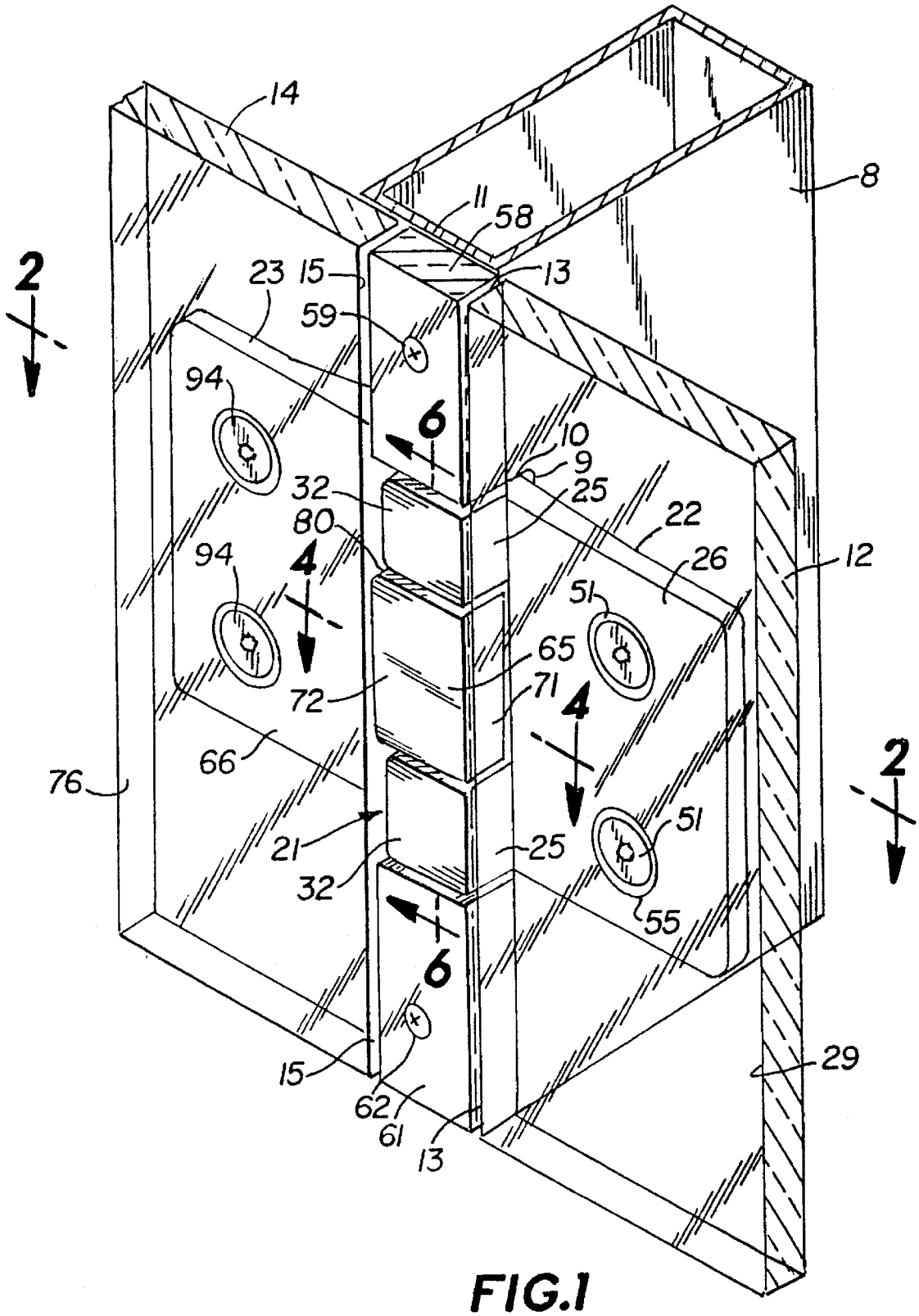
FIG. 1 is a perspective view of a hinge embodying features of the present invention shown mounted to a door and wall of an athletic court as viewed from the inside of the court and shown with the door in the closed position.

In describing the specific embodiment herein chosen for illustrating the invention, certain terminology is used for convenience which will be recognized as being employed only for convenience and having no limiting significance. The term "inner" and "outer" are with reference to inside the playing court and outside the playing court, respectively.

Referring now to FIGS. 1–6 there is shown a portion of an upright wall support 8 having a U-shaped cut-out or notch defined by an inset face 9 and a pair of spaced, opposed side faces 10 in an inner face 11 of the wall support 8. Wall support 8 is shown as a hollow post of rectangular cross section and may be an intermediate frame member connected between top and bottom frame members of a wall-supporting framework as is disclosed in detail in my copending application entitled "Movable Wall System" which disclosure is incorporated herein by reference. The back wall of the athletic court further includes a door 12 having a vertical side edge or face 13 and a wall 14 having a vertical side edge or face 15. The vertical side edge or face 13 of the door is opposite and spaced from the vertical edge face 15 of the wall to form a gap therebetween that is slightly less than the width of the wall support 8. The door and wall 14 preferably are made of a transparent plastic or glass material. The vertical side edge or face 13 of the door is located just to one side of one corner of the wall support 8. The vertical side edge or face 15 of the wall slightly overlaps the other corner of the wall support 8.

Figure 2:
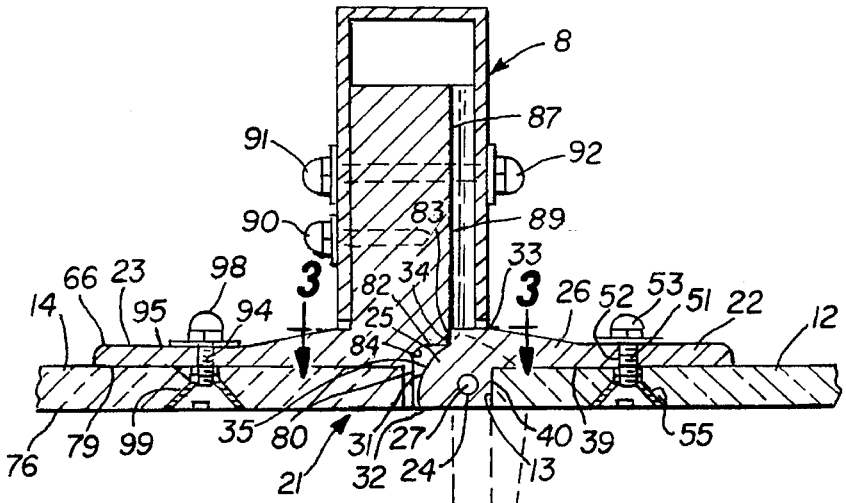
FIG. 2 is a sectional view taken along line 2—2 of FIG. 1 with the open position for the door shown in dashed lines.
Figure 3:
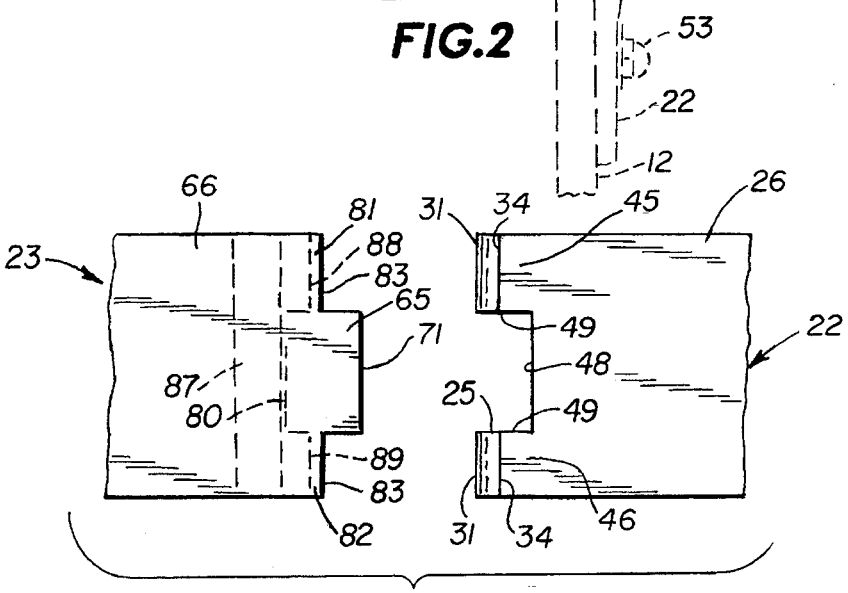
FIG. 3 is a schematic sectional view taken along line 3—3 of FIG. 2 with the first and second hinge members separated to show the edge faces with the end sections and base portion profile shown in dashed lines.
Figure 4:
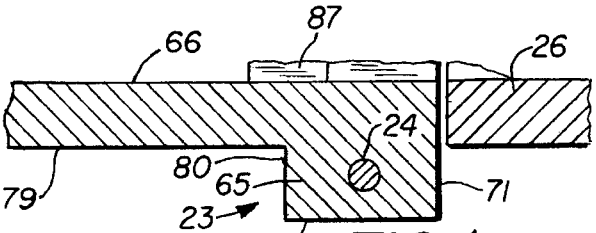
FIG. 4 is a sectional view taken along line 4—4 of FIG. 1.
Figure 5:
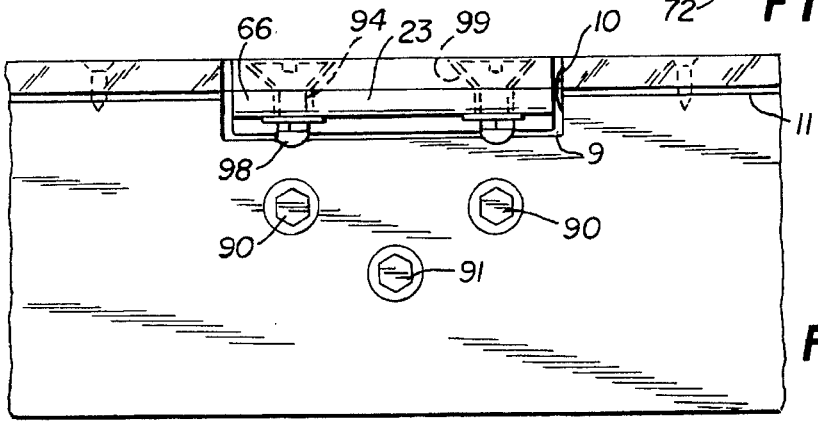
FIG. 5 is a side elevation view of the assembly shown in FIG. 2.
Figure 6:
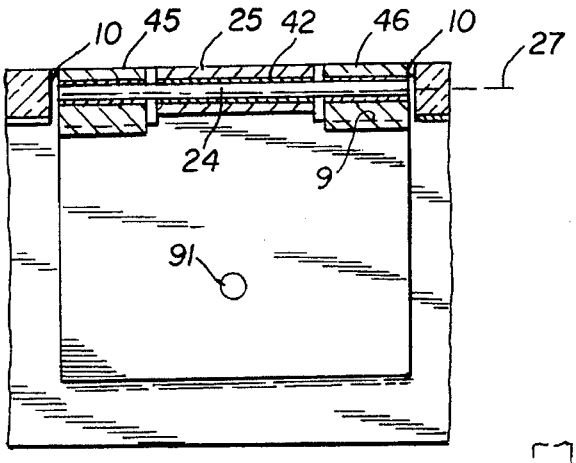
FIG. 6 is a sectional view taken along line 6—6 of FIG. 1.

A first embodiment of a hinge 21 is shown as mounted between the door and wall and pivotally connects the door 12 to the wall 14 so that the door will move between a closed position and an open position at 90 degrees to the closed position as shown in dashed lines in FIG. 2. The hinge 21 in general includes a movable first hinge member 22 and a stationary second hinge member 23 which are pivotally joined by a pintle or pivot pin 24 to pivot about a pivot axis 27. The typical installation uses two hinges, namely an upper hinge and a lower hinge. In the arrangement shown in FIGS. 1–6 the pivot axis 27 is substantially centered between the spaced, opposed edge faces 13 and 15 of the door and wall, respectively.

The first hinge member 22 has a first knuckle portion 25 and a relatively flat, first leaf portion 26 connected to the first knuckle portion 25. The first knuckle portion has a flat end face 31 and a flat inner face 32 and outer face 33 spaced from and parallel to one another and transverse to the end face 31. An inset end face 34 is disposed between adjacent the outer face 33 and inner face 32 and parallel to and spaced from end face 31 with a curved or radiused face 35 between the end face 31 and inset end face 34. The curved face 35 is formed on a radius with the pivot axis 27. The inner face 32 is located in the gap between edge faces 13 and 15 and is in substantially the same plane as the inner faces 29 and 76 of the door and wall, respectively, when the door is closed. An L-shaped notch is provided in an inner face of the first hinge member that is defined by a recessed inner face 39 and an inside face 40 that is spaced from and parallel to end face 31. Inside face 40 forms the inside boundary of the first knuckle portion 25. This notch defined by faces 39 and 40 is sized in relation to the thickness of the door 12 to recess an end portion of the door 12 so that the door fills the notch and the inner face 29 of the door is flush or in the same plane as the inner face 32 of the hinge.

The knuckle portion 25 carries an oil impregnated bronze bushing 42 providing a bearing surface for the pintle 24. The first knuckle portion 25 of the first hinge member is constructed to locate the pintle 24 and pivot axis 27 closely adjacent to the end face 31. The pivot axis 27 is substantially centered in the width dimension of the first knuckle portion 25 which is between the end face 31 and inside face 40 so that the end faces of the pivoted ends of the hinge members remain in close proximity as the first hinge member is moved between the open and closed positions. Stated another way the distance from the pivot axis to the first end face 31 and the distance from the pivot axis to the inset end face 40 is substantially the same. This serves to minimize the gap between the side edges of the door and wall. The pivot axis 27 is also located between the planes of the recessed inner face 39 and inner face 32. The inset face 40 forms a stop for the door 12 and positions the vertical side edge or face 13 of the door inwardly from end face 31 and inwardly from pintle 23 along the first hinge member so as to be inside of the vertical edge face 13 of the pivot axis 27 so the door is inwardly of or does not go past the pivot axis 27. This is different from the hinge disclosed in the above mentioned U.S. Pat. No. 4,574,426 in which the pintle is located a substantial distance inward from the end edge of the hinge member and the vertical side edge of the door extends beyond the pivot axis causing a backswing in the door in the open position.

As viewed in elevation, the first knuckle portion 25 is forked, bifurcated or is separated into a pair of spaced knuckle sections 45 and 46 that are separated by having a centrally disposed U-shaped groove defined by a centrally disposed inset end face 48 and a pair of opposed spaced side faces 49 at right angles to inset end face 48.

Inset end faces 34 of first sections 45 and 46 and inset end face 48 form what is herein referred to as a first stop face for the first hinge member in the closed door position and end faces 31 of sections 45 and 46 provide what is herein referred to as a third stop face for the first hinge member in the open position.

The first hinge member 22 is attached to the door by a pair of bolts 51 extending through holes in the door and into internal threads 52 in the first leaf portion 26. A cap nut 53 threads on the outer externally threaded end of each bolt 51 to lock the bolt in place. The bolt has a beveled head and there is a complimentary beveled hole in the inner surface of the door 12 so the flat top surface of the head is flush with the inner face 29 of the door. The first hinge member 22 is preferably made of cast aluminum. A plastic sleeve 55 with a truncated head section and a tubular base section slidably fits in the hole in the door and receives the bolt 51.

A filler strip 58 is shown secured in the gap between the wall 14 and closed door 12 above the hinge 21 by a screw 59 fastener that threads into the wall support and a filler strip 61 is shown secured in the gap between the wall 14 and closed door 12 below the hinge 21 by a screw fastener 62 that threads into the wall support 8. The thickness of these filler strips is the same as the thickness of the door and walls and preferably of the same material to provide a smooth, planar playing surface inside the court.

The second hinge member 23 has a second knuckle portion 65 and a flat second leaf portion 66 connected to the second knuckle portion 65. The second knuckle portion 65 has a flat end face 71 and a flat inner face 72 are at right angles to end face 71. The inner face 72 is in the gap between the opposed edge faces of the door and wall and is in substantially the same plane as the inner faces 29 and 76 of the door and wall when the door is in the closed position. The second knuckle portion 65 is shorter in width (hinge dimension transverse to pivot axis 27) with respect to the full width of the second hinge member and sized so as to slide into the groove defined by faces 48 and 49 in the first hinge member to provide a tongue and groove type fitting. A pair of end sections 81 and 82 of the second knuckle portion extend beyond the groove to provide an inset end face 83 that is inset with respect to end face 71 together with inset inner faces 84 on both sides of second knuckle portion 65 that are inset with respect to recessed inner face 79 described hereinafter. An L-shaped notch is formed in an inner face of the second hinge member that is defined by a recessed inner face 79 and an inside face 80 and is sized to receive an end portion of the wall 14 so that the wall fills the notch and an inner face 76 of the wall is flush with the inner face 72 of the hinge. The second knuckle portion 65 is constructed to locate the pintle 24 and pivot axis 27 closely adjacent to the end face 71. The pivot axis 27 is substantially centered in the width dimension of the second knuckle portion which is between end face 71 and inside face 80. Stated another way the distance from the pivot axis to the second end face 71 and the distance from the pivot axis to the inset end face 80 is substantially the same. This serves to minimize the gap between the side edges of the door and wall. The pivot axis 27 is also located between the planes of the recessed inner faces 79 and inner face 72. The first and second knuckle portions 25 and 65 are in alignment along the pivot axis 27 and have substantially the same width dimension in a direction transverse to the pivot axis along the leaf portions.

End faces 71 and 83 of the second hinge member form what is herein referred to as a second stop face and abut against end faces 48 and 34, respectively, of the first hinge member to hold the first hinge member in the closed position.

The end sections 81 and 82 of the second hinge member overlap or cover the curved face 35 of the first hinge member 22 as the first hinge member moves between the closed and open positions so there is no substantial gap or opening between the adjacent end edges of the two hinge members in which injury, the catching of clothing or the like could be caused. This is in contrast to the hinge disclosed in U.S. Pat. No. 4,574,426 in which there is a substantial opening between the adjacent end faces of the two hinge members.

The end face 31 of the first hinge member provide what is herein referred to as a third stop face and inset inner faces 84 of the second hinge member provide what is herein referred to as a fourth stop face to provide a stop for the first hinge member in the open position which is at 90 degrees to the closed position. The inner faces 32 and 72 of the knuckle portions as viewed from inside the court are 4-sided and of a rectangular shape and substantially fill the gap between the opposed edge faces 13 and 15 of the door and wall.

The second hinge member 23 has a base portion 87 extending rearwardly of the second knuckle portion at right angles to the second leaf portion and base portion 87 is sized to slide into and fit complimentary within the inside of the wall support 8. The base portion 87 has a pair of spaced L-shaped notches 88 and 89 in one side which permit a portion of the knuckle sections 45 and 46 to slide thereinto when the first hinge member moves to the closed position. Two spaced bolts 90 extend through holes in the wall support and thread into internally threaded holes in the base portion 87 and a third bolt 91 extends through aligned holes in the wall support and base portion and has a cap nut 92 on the end of bolt 91 to attach the hinge 21 to the wall support.

The second hinge member 23 is attached to the wall 14 by a pair of fastening means in the form of bolts 94 that extend through the wall 14 and are threaded into internal threads 95 in the second leaf portion 66. A steel cap nut 98 threads onto the outer end of the bolt 94 to lock the bolt in place. Again as above described the bolt has a beveled head and there is a beveled hole in the wall 14 so that the top surface of the head is flush with the inner surface of the wall. The second hinge member 23 is preferably made of cast aluminum. A plastic sleeve 99 slidably fits in the hole in the wall and bolt 94 fits in the sleeve.

Figure 7:
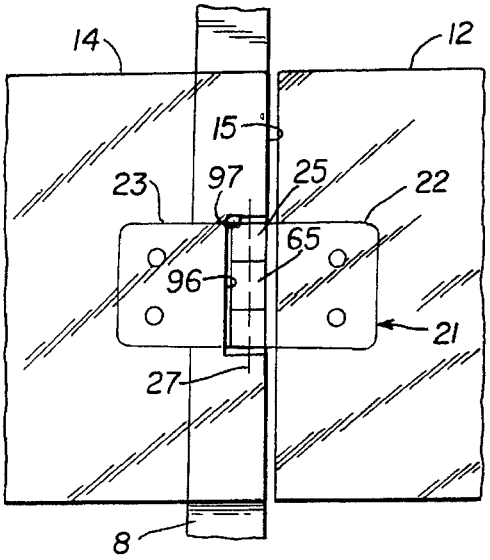
FIG. 7 is a schematic elevational view of the hinge shown in FIGS. 1–6 mounted in a notch in the wall as viewed from the inside of the court.

Referring now to FIG. 7 there is shown a wall 14 provided with a modification in the form of a U-shaped notch defined by an inset face 96 and a pair of opposed, spaced side faces 97 in the edge face 15 of the wall. The first and second knuckle portions 25 and 65 of hinge 21 fit in and substantially fill the notch. The edge face 13 of the door is in close proximity to edge face 15 so that in this modified form no filler strips are required as is shown in FIG. 1.

Figure 8:
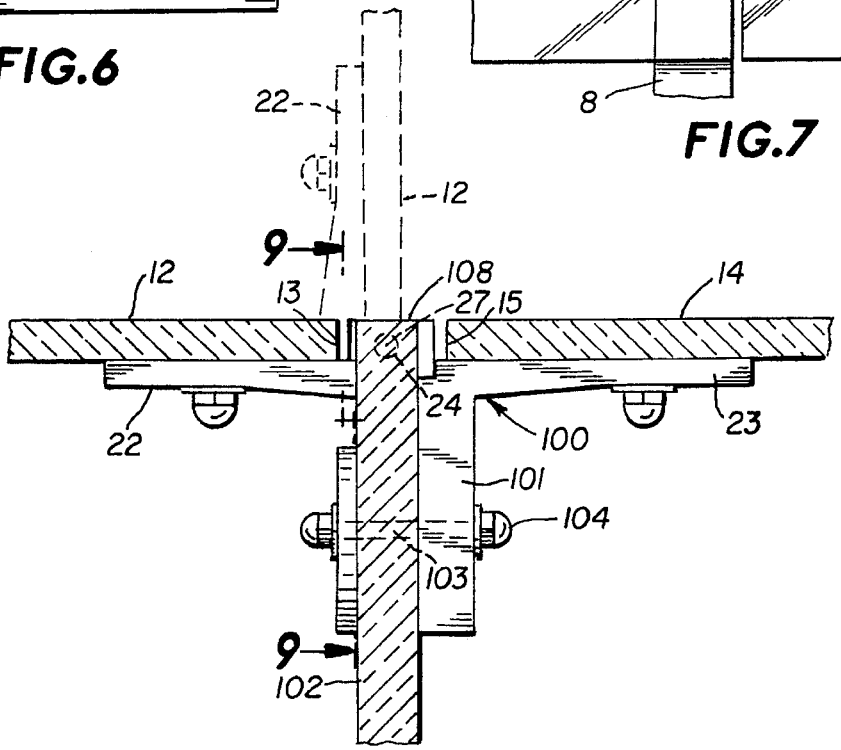
FIG. 8 is a view similar to the view of FIG. 2 showing a second embodiment of the hinge of the present invention with a rib being used as a wall support.
Figure 9:
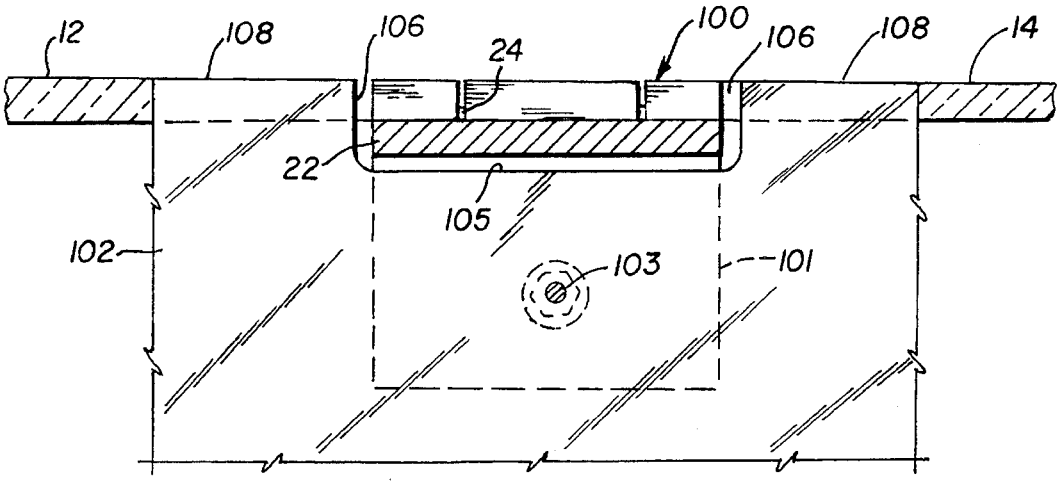
FIG. 9 is a sectional view taken along line 9—9 of FIG. 8.

Referring now to FIGS. 8 and 9 there is shown a second embodiment of a hinge 100 having the same first hinge member 22 and second hinge member 23 connected by a pintle 24 to define a pivot axis 27 as above described but with a modified form of base portion 101 that is thinner than base portion 87 above discussed. Base portion 101 is of a generally rectangular shape. The base portion 101 extends through support rib 102 via notch defined by notch faces 105 and 106 and is fastened to the back side face of rib 102 by a bolt fastener 103. The back side face is the side face opposite the door 12 and the one facing the wall 14. By attaching to the back side face of rib 102, the load on the hinge is not restricted to the head of fastener 103 only so that the load stress around a head of the fastener in the fin is greatly reduced.

The rib 102 is disposed in the gap between the door and wall and flat inner faces 108 of the rib on both sides of the notch defined by faces 105, 106 are in the same plane as the inner faces of the door and wall to form a part of the playing surface when the door is closed. The leaf portions of the hinge members 22 and 23 extend beyond both sides of the rib. The bolt fastener 103 extends through holes in the base portion 101 and rib 102 and has a steel cap nut 104 at one end to lock the bolt. The rib 102 has a notch defined by an inset face 105 and a pair of opposed, curved side faces 106 and of sufficient depth to allow the hinge to be recessed therein in the same way as with the notch defined by faces 9 and 10 above described.

Figure 10:
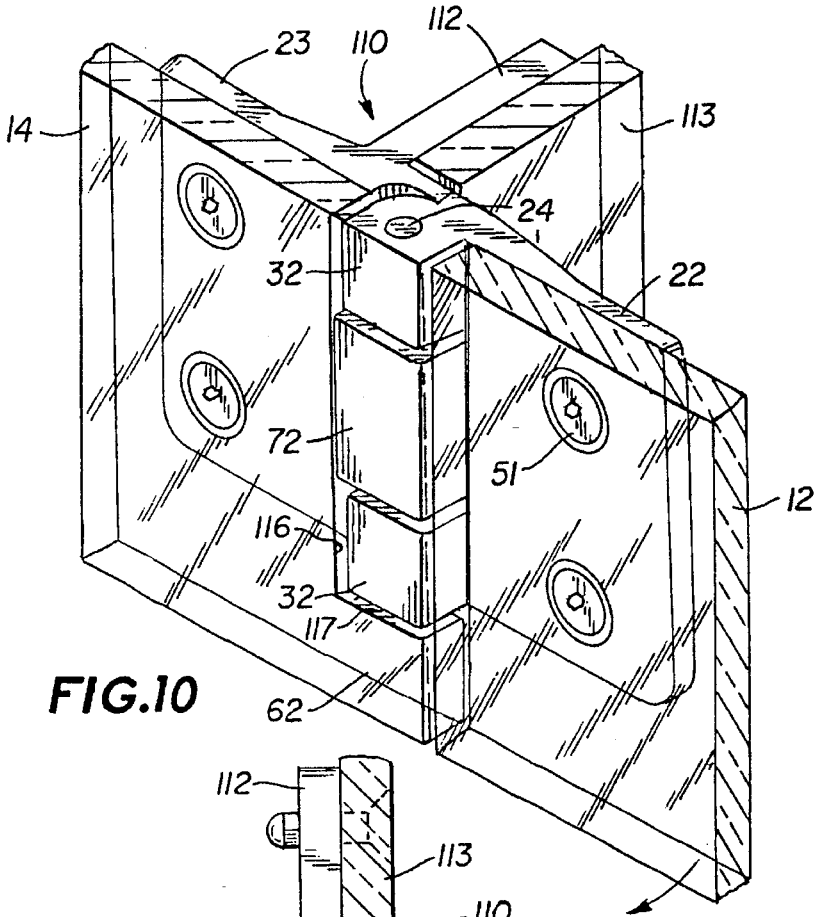
FIG. 10 is a perspective view of a third embodiment of the present invention.
Figure 11:
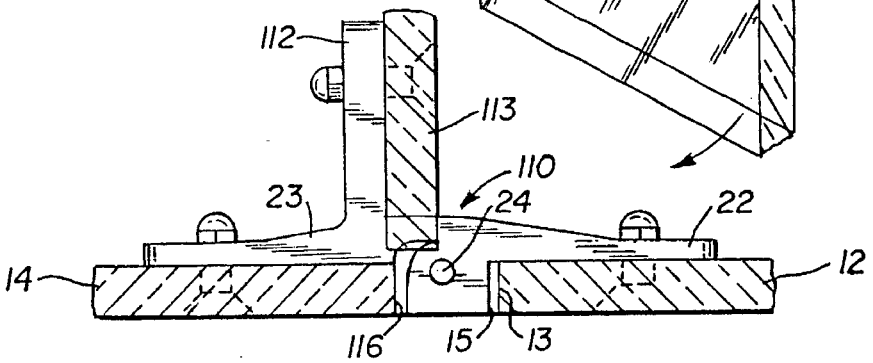
FIG. 11 is a top elevation view of the hinge shown in FIG. 10.

Referring now to FIGS. 10 and 11, there is shown a third embodiment of a hinge 110 having the same first hinge member 22 and second hinge member 23 connected by a pintle 24 as above described. The door 12 is fastened to member 22 and the wall 14 is fastened to member 23. Hinge 110 has a narrower base portion 112 projecting out from the second hinge member 23. Base portion 112 attaches to a narrower support fin 113 in the same manner as the support fin 102 above described. This was done so the thickness of the base portion 112 is the same as the thickness of the support fin 113 being used. Since the narrower support fin does not fill the gap between edge faces 13 and 15 a modification is necessary.

Figure 12:
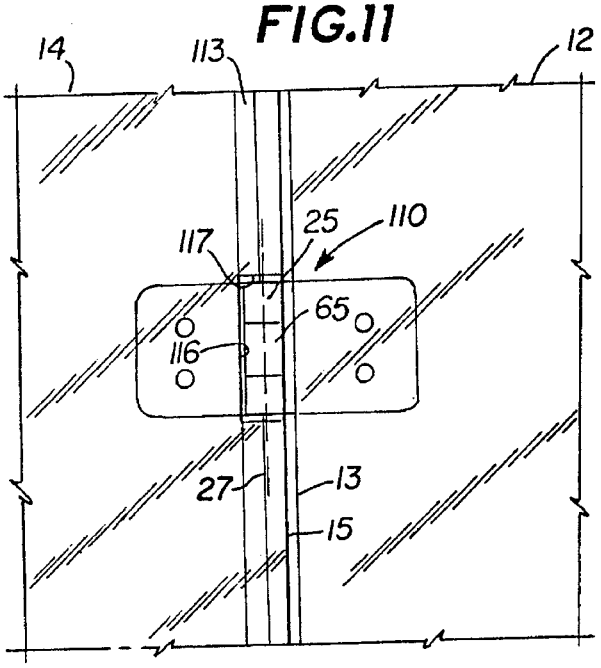
FIG. 12 is a schematic elevational view of the hinge shown in FIGS. 10 and 11 mounted in a notch in the wall as viewed from the inside of the court.

Referring now to FIGS. 10–12 there is shown a wall 14 provided with a modification in the form of a U-shaped notch defined by an inset face 116 and a pair of opposed, spaced side faces 117 in the edge face 15 of the wall. The first and second knuckle portions 25 and 65 of hinge 110 fit in and substantially fill the notch 117. The edge face 13 of the door is in close proximity to edge face 15 so that in this modified form a narrower support fin 113 can be used if required.

Although the present invention has been described with a certain degree of particularity, it is understood that the present disclosure has been made by way of example and that changes in details of structure may be made without departing from the spirit thereof.

What is claimed is:

1. In a hinged door and wall assembly the combination comprising:

a wall support having an inner face with a notch, a door having an inner face and a vertical side edge, a wall having an inner face and a vertical side edge spaced from said vertical side edge of said door to form a gap between said vertical side edges, a hinge including a first hinge member attached to the door, a second hinge member attached to the wall and a pintle connecting said first and second hinge members defining a pivot axis for pivotally connecting said door to said wall for the movement of said first hinge member and door between an open position and a closed position, said first hinge member including a first knuckle portion and a first leaf portion connected to said first knuckle portion, said first hinge member having a first end face and a first notch defined by a first recessed inner face and a first inset face perpendicular to said first recessed inner face, said second hinge member having a second knuckle portion and a second leaf portion connected to said second knuckle portion, said second hinge member having a second end face and a second notch defined by a second recessed inner face and a second inset face perpendicular to said second recessed inner face, said second hinge member having a base portion attached to said wall support, said base portion extending away from said knuckle portion and at right angles to said second leaf portion, said first and second hinge members being recessed in said notch of said wall support, said door being recessed in said first notch and said wall being recessed in said second notch whereby said inner faces of said first and second hinge members, said door and said wall are in substantially the same plane when said door is in the closed position, said first hinge member having a first stop face for the closed position, said second hinge member having second stop face for the closed position that abuts against said first stop face to inhibit the movement of the door past an end to end disposition of said door with said wall in said closed position, said first hinge member having a third stop face provided by said first stop face for the open position, said second hinge member having a fourth stop face that abuts against said third stop face to inhibit the movement of the door past 90 degrees from the closed position in said open position, the distance from the pivot axis to said first end face and the distance from the pivot axis to said first inset face being substantially the same and the distance from the pivot axis to said second end face and the distance from the pivot axis to said second inset face being substantially the same to minimize the gap between said door and wall, said first recessed inner face of said first hinge member moving toward said second recessed inner face of said second hinge member in moving to said open position, and mounting base means extending transverse to said second hinge member for mounting said second hinge member to a support adjacent an outer face of said second hinge member.

2. In an assembly as set forth in claim 1 wherein said base portion is attached to said wall support by fastening means extending through said wall support and base portion.

3. In an assembly as set forth in claim 1 wherein said door is attached to said first hinge member by fastening means extending through said door and into said first leaf portion.

4. In an assembly as set forth in claim 1 wherein said wall is attached to said second hinge member by fastening means extending through said wall and into said second leaf portion.

5. In a hinged door and wall assembly, the combination comprising:

a door having a straight, vertical edge face, a wall having a straight, vertical edge face opposite and spaced from said vertical edge face of said door to form a gap of substantially uniform width between said edge faces, a hinge in said gap pivotally connecting said door to said wall, said hinge including a first hinge member attached to said door and a second hinge member attached to said wall, said first hinge member movable between an open position and a closed position, said first hinge member including a first knuckle portion and a first leaf portion connected to said first knuckle portion, said first hinge member having a first end face and a first notch defined by a first recessed inner face and a first inset face perpendicular to said first recessed inner face, said second hinge member having a second knuckle portion and a second leaf portion connected to said second knuckle portion, said second hinge member having a second end face and a second notch defined by a second recessed inner face and a second inset face perpendicular to said second recessed inner face, a pintle extending through said first and second knuckle portions to define a pivot axis, an inner face of said first and second knuckle portions, said door and said wall being in substantially the same plane when said door is in the closed position, the distance from the pivot axis to said first end face and the distance from the pivot axis to said first inset face being substantially the same and the distance from the pivot axis to said second end face and the distance from the pivot axis to said second inset face being substantially the same to minimize the gap between said door and wall, said first recessed inner face of said first hinge member moving toward said second recessed inner face of said second hinge member in moving to said open position, and mounting base means extending transverse to said second hinge member for mounting said second hinge member to a support adjacent an outer face of said second hinge member.

6. A hinge for pivotally connecting a door to an adjacent wall at adjacent side edges of the door and wall forming a gap between said door and wall comprising:

first and second hinge members pivotally connected together by a pintle in first and second knuckle portions, respectively, for the movement of said first hinge member about a pivot axis between an open and closed position, said first and second hinge members having inner faces, said first hinge member having a first notch in said inner face to recess the door in said first notch with said first knuckle portion having a first end face at a pivot end of said first hinge member and a first inset face located a distance away from said first end face along said first hinge member in a direction extending away from said first end face past said pintle forming a stop for a side edge of said door to dispose said side edge at said first inset face, said second hinge member having a second notch in an inner face to recess the wall in said second notch with said second knuckle portion having a second end face at a pivot end of said second hinge member and a second inset face located a distance away from said second end face along said second hinge member in a direction extending away from said second end face past said pintle forming a stop for a side edge of said wall to dispose said side edge of said wall at said second inset face, said door and wall recessed to the extent to provide a substantially flush inner door face and inner wall face when the door is in the closed position, said first and second knuckle portions having inner faces between said side edges of said door and wall substantially in the same plane as said inner faces of said door and wall, the distance from the pivot axis to said first end face and the distance from the pivot axis to said first inset face being substantially the same and the distance from the pivot axis to said second end face and the distance from the pivot axis to said second inset face being substantially the same to minimize the gap between said door and wall, said inner face of said first hinge member moving toward said inner face of said second hinge member in moving to said open position, and mounting base means mounted to and extending transverse to said second hinge member for mounting said second hinge member to a support adjacent an outer face of said second hinge member.

7. A hinge as set forth in claim 6 wherein said wall has a notch in said side edge of said wall, said notch being of a size related to the height and width of said first and second hinge members to substantially fill said notch, said first and second hinge members having inner surface portions in substantially the same plane as said inner faces of said door and wall when the door is in the closed position.

8. A hinge as set forth in claim 6 wherein said first knuckle portion is connected to a first leaf portion and a second leaf portion is connected to said second knuckle portion.

9. A hinge as set forth in claim 6 wherein said hinge members are made of cast aluminum and said first and second leaf portions have internally threaded holes to receive a fastening means that extend through said door and wall and thread into said internally threaded holes.

10. A hinge as set forth in claim 6 wherein said first knuckle portion is bifurcated into a pair of spaced knuckle sections separated by a centrally disposed generally U-shaped groove.

11. A hinge as set forth in claim 10 wherein the width of said second knuckle portion is less than the full width of said second hinge member and sized to slide into said groove of said first hinge member in a tongue and groove type fitting.

12. A hinge as set forth in claim 11 wherein said first hinge member has a curved face and said second hinge member has a pair of end sections, each said end section extending parallel to said pivot axis and laterally beyond the ends of said second knuckle portion and providing a cover that moves over said curved face between said open and closed positions.

13. A hinge as set forth in claim 6 wherein said first hinge member has a first stop face for the closed position, said second hinge member having a second stop face that abuts against said first stop face to inhibit movement of the door past an end to end position with said door in said closed position.

14. A hinge as set forth in claim 13 wherein said first hinge member has a third stop face for the open position, said second hinge member having a fourth stop face that abuts against said third stop face to inhibit movement of the door past 90 degrees from the closed position in the open position.

15. A hinge as set forth in claim 6 wherein said first knuckle portion has an inset end face adjacent and parallel to said first end face and a curved face between said first end face and said inset end face, said curved face being formed on a radius with said pivot axis.

16. A hinge as set forth in claim 6 wherein said wall and door form a part of a back wall of an athletic court.

17. A hinge as set forth in claim 6 wherein said pivot axis is disposed between said inner faces of said door and wall with the door in the closed position.

18. A hinge as set forth in claim 17 including filler means in said gap above and below said first and second hinge members, said filler means having inner surfaces in substantially the same plane as said inner faces of said door and wall.

19. A hinge as set forth in claim 6 wherein said wall support is a hollow post and said base portion is inside said hollow post.

20. A hinge as set forth in claim 6 wherein said wall support is a fin having a notch, said base portion extending through said notch and said base portion is attached by a fastener with a head in said fin to a back side face of said fin opposite said door to reduce the load stress around said head in said fin.

21. A hinge as set forth in claim 20 wherein said fin is disposed between said door and wall and an inner face of said fin is in substantially the same plane as the inner face of said door and wall when said door is in the closed position.

22. A hinge as set forth in claim 6 wherein said second hinge member having a second leaf portion connected to said second knuckle portion and a transverse flange for fastening to a fin behind a wall support.

* * * * *